US005172571A

United States Patent [19]

Gariboldi

[11] Patent Number: 5,172,571

[45] Date of Patent: Dec. 22, 1992

[54] NEEDLE SELECTION DEVICE FOR CIRCULAR KNITTING MACHINE, IN PARTICULAR FOR WOMEN'S STOCKINGS

[76] Inventor: Franco Gariboldi, Viale Banchiero 9, Condove (Torino), Italy

[21] Appl. No.: 676,325

[22] Filed: Mar. 28, 1991

[51] Int. Cl.[5] ..... D04B 15/66

[52] U.S. Cl. ..... 66/219

[58] Field of Search ..... 66/218, 219, 220

[56] References Cited

U.S. PATENT DOCUMENTS

| | | | |
|---|---|---|---|
| 3,972,206 | 8/1976 | Mureso | 66/219 |
| 3,973,414 | 8/1976 | Golladay et al. | 66/219 X |
| 4,196,599 | 4/1980 | Guell | 66/220 X |
| 4,688,404 | 8/1987 | Elsässer | 66/219 |
| 4,989,424 | 2/1991 | Furia | 66/219 |
| 5,070,711 | 12/1991 | Gargiani | 66/219 |

FOREIGN PATENT DOCUMENTS

| | | | |
|---|---|---|---|
| 2318377 | 10/1974 | Fed. Rep. of Germany | 66/219 |
| 1257491 | 12/1971 | United Kingdom | 66/219 |
| 2112822 | 7/1983 | United Kingdom | 66/219 |

*Primary Examiner*—Werner H. Schroeder
*Assistant Examiner*—John J. Calvert
*Attorney, Agent, or Firm*—McGlew & Tuttle

[57] ABSTRACT

A needle selection device for circular knitting machines for women's stockings, including a pusher jacks associated with each of a plurality of needles of a needle cylinder, each pusher jack having two heels including an upper heel interacting, in a selection position, with a lower cam and a lower heel interacting, in a selection position, with a pressure cam, acting in a radial direction with respect to the cylinder, and with a raising cam. A horizontal collar is provided formed of non-magnetic material anchored around the needle, the collar defining a plurality of radial grooves. A plurality of horizontal elastic selector jacks are positioned in one of the radial grooves. A permanently magnetized ring is fastened below the collar, facing the selector jacks, spaced a distance from the selector jacks to retain said selector jacks only when said selector jacks are inclined downwardly. A permanent magnet is supported by a fixed structure with respect to the cylinder in a region of each pressure cam for removing the selector jack from the horizontal rest position for urging the selector jack to the permanently magnetized ring, to the position inclined downwardly. A vertical tappet is provided positioned between the permanent magnet and an inclined surface of the raising cam, and positioned under the selector jack for selective detachment of the selector jack from contact with the permanently magnetized ring, whereby the position of the selector jack maintains or modifies a position of the corresponding pusher jack upon passage of the pusher jack over the pressure cam for determining non-operation or operation of a corresponding needle.

4 Claims, 5 Drawing Sheets

NEEDLE SELECTION DEVICE FOR CIRCULAR KNITTING MACHINE, IN PARTICULAR FOR WOMEN'S STOCKINGS

FIELD OF THE INVENTION

The present invention relates to a needle selection device for a circular knitting machine, in particular for the manufacture of women's stockings.

BACKGROUND OF THE INVENTION

It is known that in circular knitting machines use is made of one or more selection assemblies, arranged around the needle cylinder before each feed or drop, each assembly being constituted by an electromagnet which is of maximum width equal to the spacing of the needles and which is interposed between two permanent magnets. A pressure cam is provided which is arranged in the region of the magnet and is upstream of said electromagnet in the direction of advance of the cylinder and which has the function of pushing against the latter an oscillating selector which is accommodated in a corresponding groove of the cylinder and is associated with a pusher jack. It is widely known to control the electromagnet using pulses, according to an electronic program synchronized with the movement of the needle cylinder. This is done by means of passing, interrupting or reversing the direction of the current, in order to make it possible for the permanent magnets to selectively attract the oscillating selector and to avoid the heel of the pusher jack engaging a control cam and bringing about the deactivation of operation of the corresponding needle by weakening the electromagnets magnetic field, it is possible for the permanent magnets to push back said oscillating selector, causing the raising of the heel of the pusher jack by the same control cam and the putting into service of the corresponding needle.

It is known that in the attempt to overcome the limitations of speed and of needle fineness currently imposed, it has been proposed to replace the oscillating selector jack in the vertical groove of the needle cylinder by an elastic selector jack. Such an elastic selector jack is arranged horizontally in a corresponding radial groove of a horizontal collar fixed around the needle cylinder. The electromagnet and the relevant permanent magnets are then arranged close to the head of the horizontal selector jack which is placed in contact with the corresponding permanent magnet by the foot of the same pusher jack.

However, this known system still has the problems associated with the selection of the selector jacks by means of an electromagnet of very small dimensions and such problems increase with an increase in the speed of the cylinder and in the fineness of the needles. These problems are as a result of the precariousness of the equilibrium of the forces in play and the variations, which are difficult to evaluate, in the various factors such as friction, residual magnetism, induced magnetism and elastic forces which vary as a result of the differences in the thermal treatments and in the dimensions or bending of the different pieces. Therefore, and by way of example, in a circular machine with 400 needles, the theoretical equilibrium between the weight of a selector jack and the force of attraction which can be obtained using an electromagnet is reached at speeds which are no greater than 500 revolutions/min. and this is incompatible with the speeds, fineness and reliability currently required by the industry which uses circular machines for stockings, especially women's stockings.

SUMMARY AND OBJECTS OF THE INVENTION

The object of the present invention is to eliminate the abovementioned disadvantages and limitations and to produce a device for safe and reliable operation of the horizontal elastic selector jacks, even of minimal dimensions, permitting needle/needle selection also for very great fineness and speeds, such as is required for the manufacture of women's stockings.

According to the invention, this object has been achieved with a circular knitting machine comprising pusher jacks accommodated in the vertical grooves of the needle cylinder, horizontal elastic selector jacks which are accommodated in corresponding radial grooves of a circular collar made of non-magnetic material anchored around the needle cylinder and which have their heads extended into the corresponding groove of the needle cylinder, by providing said machine with a needle/needle selection device comprising:

- a permanently magnetized ring which is fastened to the collar of the horizontal elastic selectors at such a distance as not to influence them when they are in a rest position and, respectively, to retain them when they are in an active position, that is to say in the needle selection phase; and for each selection position:
- a permanent magnet, fastened to a fixed part of the machine in the region of the pressure cam of the pusher jacks, immediately before the selection position, with the function of inclining the selector jacks downwards, in the selection phase, from the horizontal rest position towards and as far as said retention ring;
- a vertical tappet, positioned between the magnet for displacement of the selector jacks and the active zone of the raising cam of the pusher jacks and mounted on means of vertical movement which are controlled so as to impart or not to impart to the tappet a vertical vibratory movement, the travel of which is sufficient to detach or, respectively, not to detach the selector jacks from said retention ring, and thus to make it possible not to operate or, respectively, to operate the corresponding pusher jack immediately after the passage of its lower heel in front of the pressure cam.

Advantageously, said retention ring for the selector jacks consists of a magnetic ring interposed between two collars which constitute the pole pieces and are shaped so as to concentrate the lines of flux within a short distance.

Said permanent magnet for elastic bending of the selector jacks towards the retention ring is advantageously positioned astride said retention ring and with the pole pieces slightly drawn back in relation to those of the retention ring in order to prevent contact with and thus scraping of the selector jacks.

According to a preferred embodiment, the means for the movement of said tappet are constituted by a coil which is held in position, in an elastic manner, within a magnetic field generated by a permanent magnet and is supplied with modulated current in order to transmit to the tappet a suitable vibratory movement of predetermined amplitude, frequency and phase.

The advantages obtained by virtue of the present invention consist essentially in that it is possible to use very light selector jacks, to reduce friction drastically. This occurs given that the retention ring for the selector is integral with the needle cylinder and the duration of the contact between the selector jacks and the detachment tappet is reduced to the minimum. It is further possible to keep all the needles in operation without any selection, that it is possible to operate with electronic control and thus with reliability and safety, at greater speeds and with greater fineness in relation to those achieved thus far. The device according to the invention can also be easily and simply adapted to circular machines of the type having reciprocating motion, that is to say with double selection, or of the type with needles having three positions or with vertical staggering of the upper heel of the pusher jacks.

BRIEF DESCRIPTION OF THE DRAWINGS

These and other advantages and characteristics of the invention will be understood with greater depth and clarity by any expert in the field from the description which follows and with the aid of the attached drawings which are given by way of practical exemplification of the invention, but are not to be considered as limiting, and in which.

DETAILED DESCRIPTION OF THE PREFERRED EMBODIMENT

Figure 1:
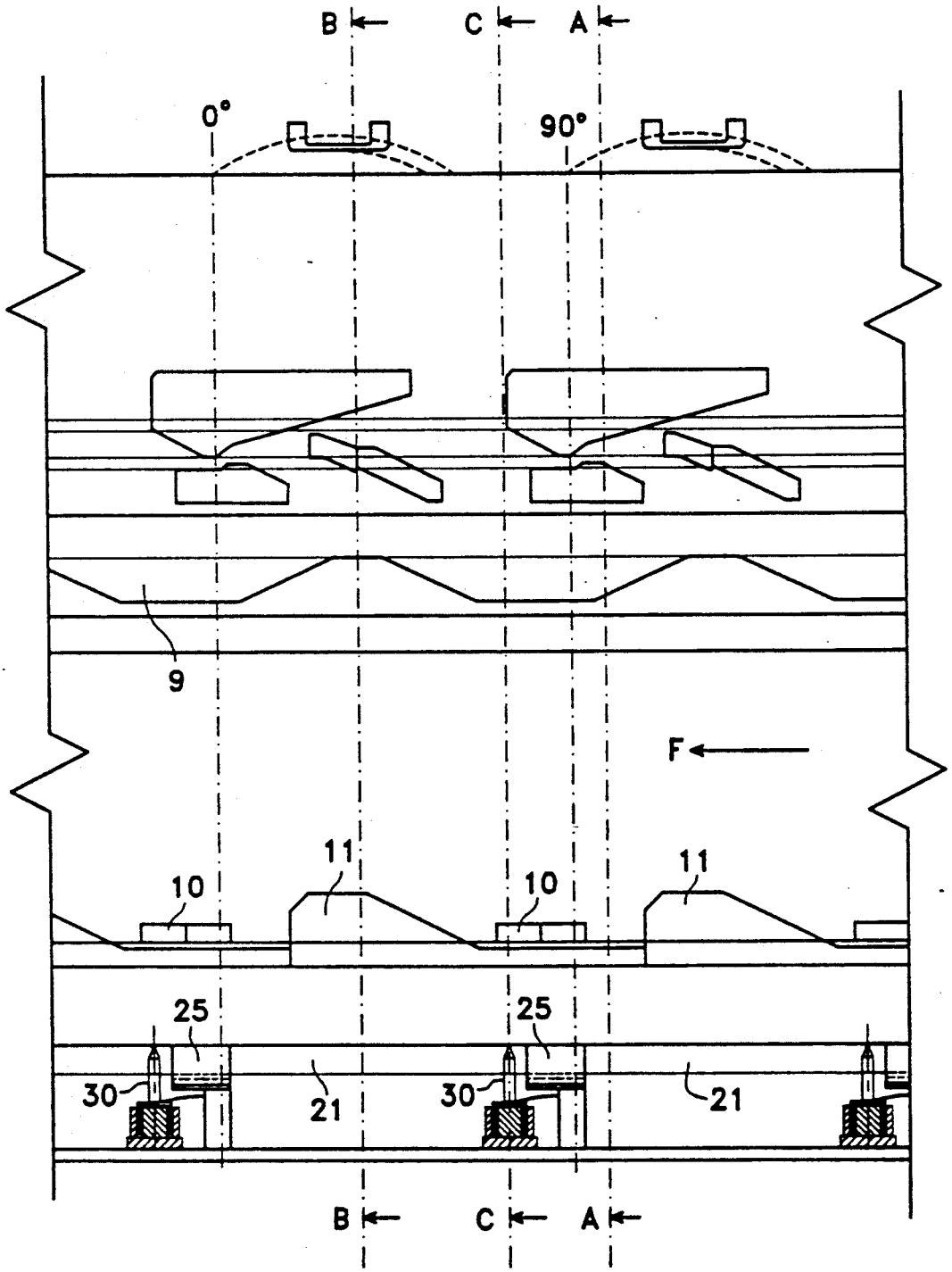
FIG. 1 represents the developed view of the cam case with the various selection elements for a circular machine according to the invention.
Figure 2:
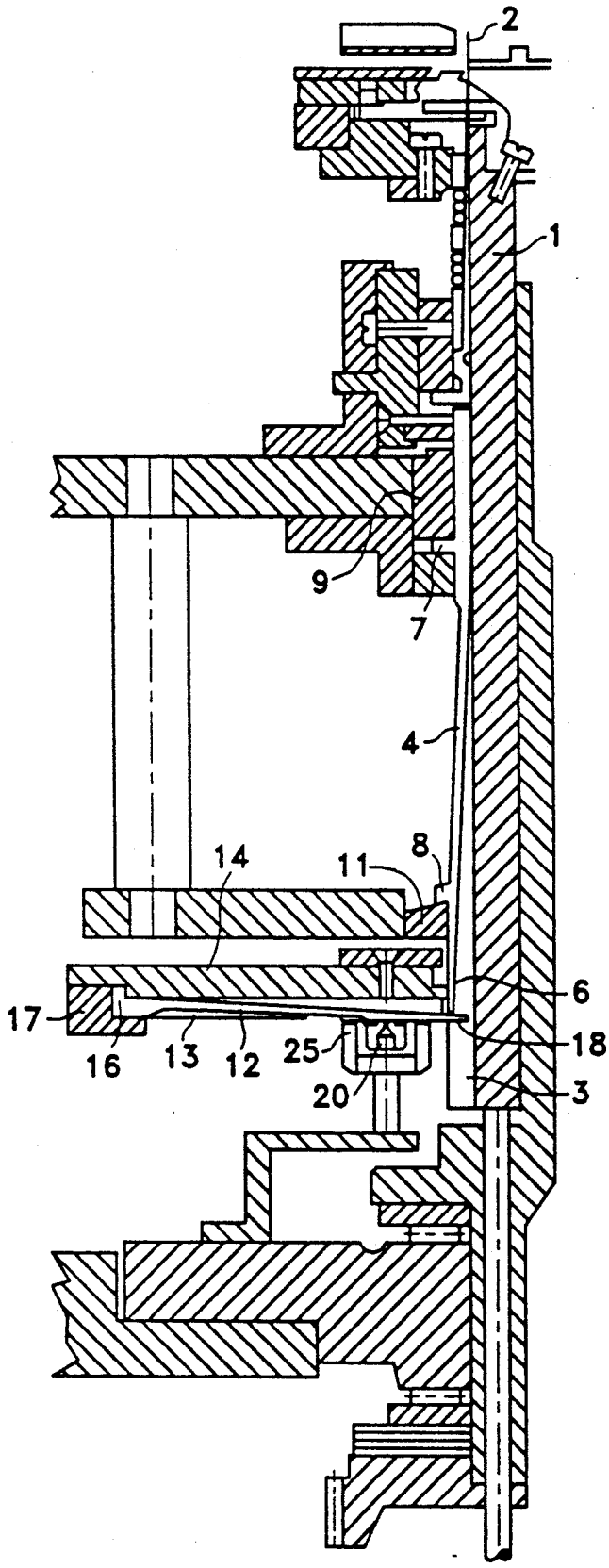
FIG. 2 represents the cross-section along A—A in FIG. 1.
Figure 3:
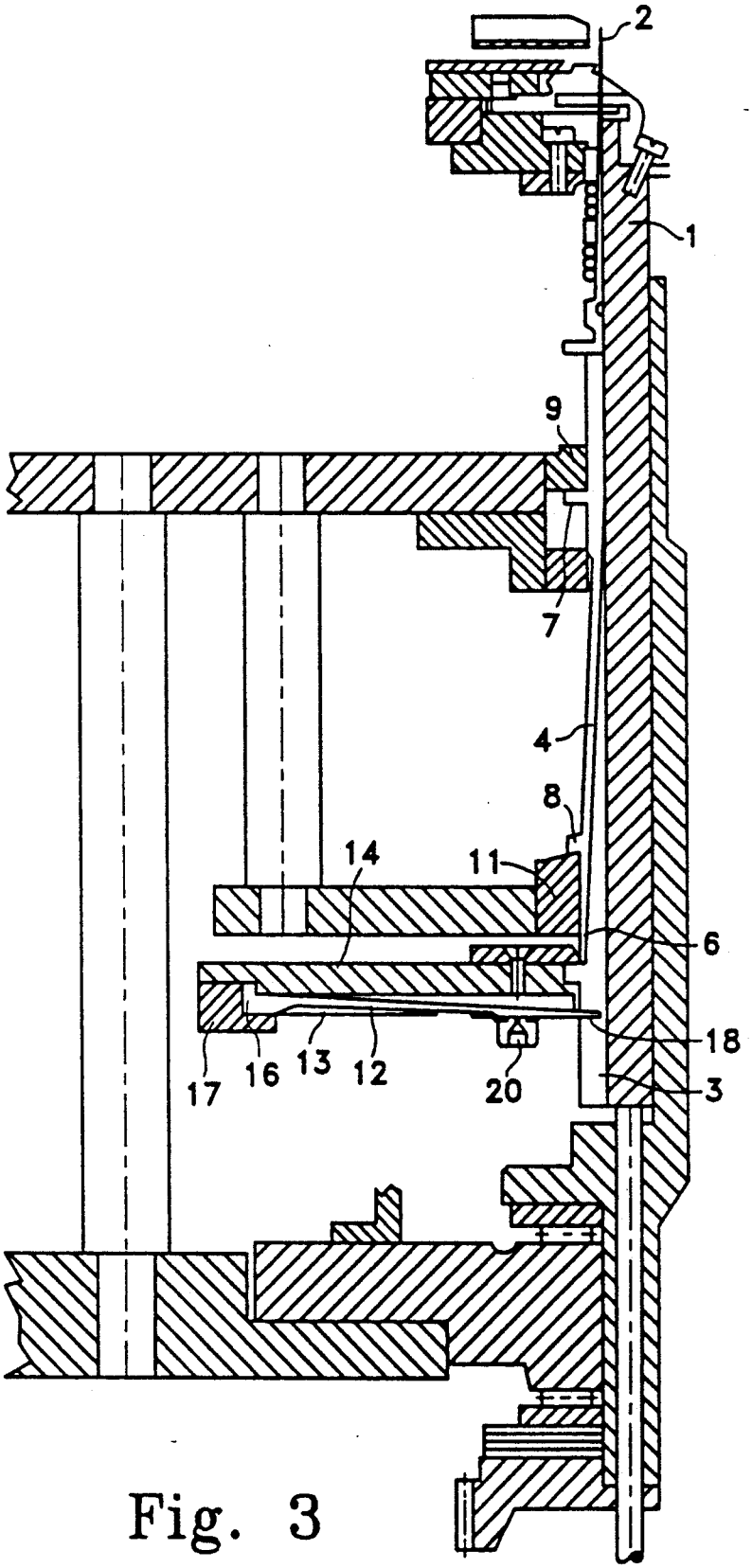
FIG. 3 represents the cross-section along B—B in FIG. 1.
Figure 4:
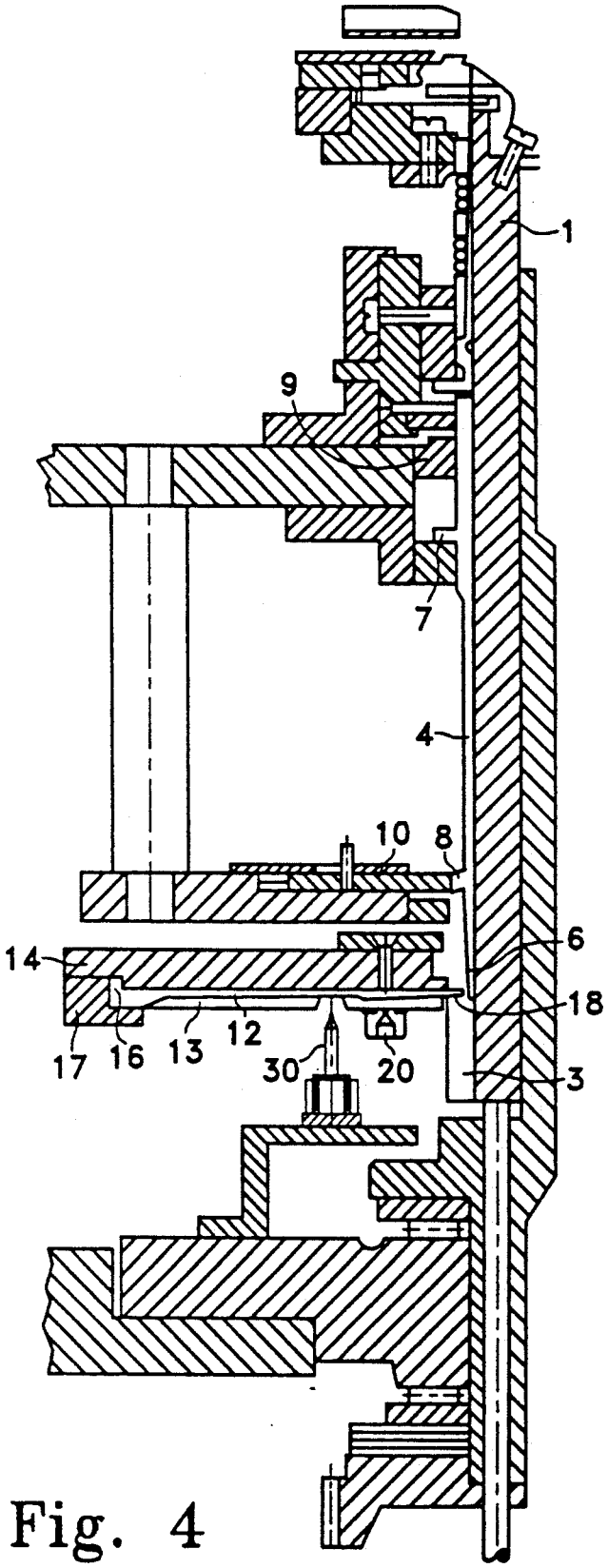
FIG. 4 represents the cross-section along C—C in FIG. 1.
Figure 5:
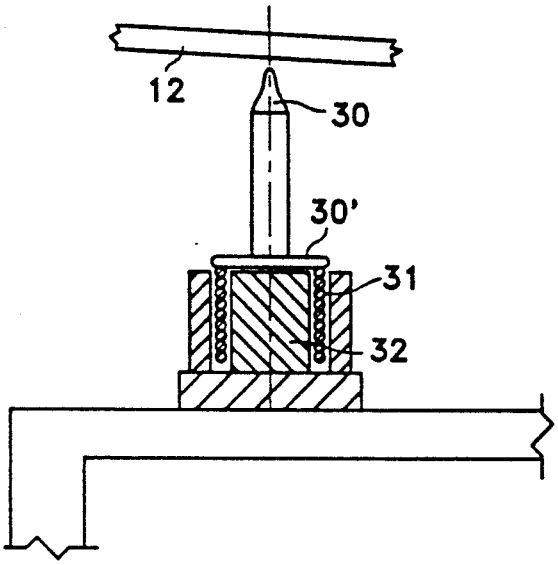
FIG. 5 represents the detail of the tappet for deactivating the selector jacks of the machine in FIG. 1 with a selector jack in the retention phase.

With reference to the figures of the attached drawings, a needle selection device according to the invention is disclosed which is for a circular knitting machine, in particular for the manufacture of women's stockings. The device comprises a vertical cylinder 1 with the needles 2 accommodated in corresponding grooves 3 of the external surface of the cylinder 1. Pusher jacks 4 are provided underneath accommodated vertically slidably in the grooves 3 of the cylinder and moreover oscillating elastically in a direction radial to the cylinder 1 between two positions, one of selection and the other of non-operation of the needles, according to which the back of the pusher jacks is raised or, respectively, in contact with the bottom of the groove 3 of the cylinder 1. Each pusher jack 4 is provided with two heels 7, 8 which are turned towards the outside. The upper heel 7 interacts with a cam 9 for lowering from the position of needle in operation to that of selection. The other, lower heel 8 interacts with a first centripetal pressure cam 10 for the thrust against the bottom of the groove 3 before each selection assembly, and with a second, raising cam 11 for. setting in operation the corresponding needle 2. The horizontal elastic selector jacks 12 are accommodated in corresponding radial grooves 13 of the lower base of a horizontal collar 14 made of non-magnetic material which is anchored on the needle cylinder. The grooves 13 are aligned with the grooves 3 of the cylinder 1. Each horizontal jack 12 has its foot 16 bent at right angles and locked against the shoulder of the collar by means of a ring 17 made of non-magnetic material and in such a manner that in the rest position the foot 16 has its back in contact with the bottom of the groove 13, and its head 18 extended into the corresponding groove 3 of the cylinder 1 of the needles 2.

Figure 6:
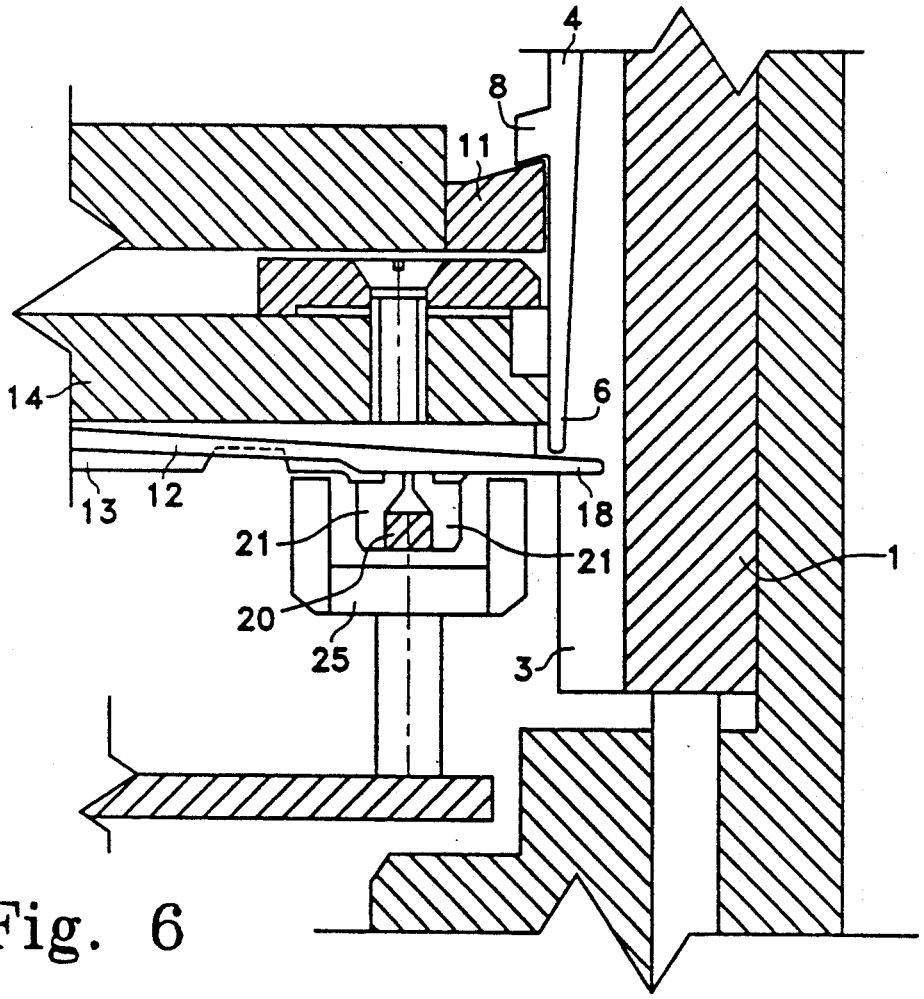
FIG. 6 represents the detail of the means of retention of the selector jacks of the machine in FIG. 1.

The selection device itself according to the invention comprises a permanently magnetized ring 20 which is fastened to the abovementioned collar 14 in a position underneath the horizontal selector jacks 12. The ring 20 is positioned close to heads 18 of the jacks 12 a vertical separation between the heads 18 and the ring 20 is provided such as not to influence them when they are in rest position, that is to say with their backs in contact with the bottom of the relevant grooves, and, respectively, to bring about elastic deformation with bending downwards and their retention. Advantageously, this retention ring 20 for the selector jacks 12 is interposed between two concentric circular collars 21 (see FIG. 6) which are made of magnetizable material and the upper bases of which, which constitute the pole pieces, are shaped so as to concentrate the flux lines within a short distance. The selection device also includes a permanent magnet 25, fastened to a fixed part of the machine, in the region of the pressure cam 10 and immediately before the selection position, which exerts a field of attraction which is sufficiently powerful and wide in an angular direction to remove, that is to say bend downwards, the selector jacks 12 from the rest, position to that of retention by said retention ring 20. Advantageously, said permanent magnet 25 has its pole pieces arranged astride said retention ring 20 and with the free ends situated in a slightly drawn back, that is to say lower, plane in relation to that of the pole pieces of the retention ring 20 so as to attract the selector jacks 12 without coming into contact therewith and thus avoiding any resistance as a result of sliding friction. The selection device also include a tappet 30 which emerges from a small plate 30' fastened on the top of an annular coil 31. The tappet 30 is axially and elastically movable on a permanent magnet 32 which in turn is supported by a fixed part of the machine, between the removal magnet 25 and the incline of the raising cam 11. A free end of the tappet 30 lies slightly underneath the plane of the selector jacks 12 and externally (in centrifugal direction in relation to the cylinder 1) to the attraction magnet 25 in such a manner that, by supplying the coil 31 with modulated current, the tappet 30 is subjected to a vertical oscillatory movement which is dependent on the modulated supply current of the bobbin. In this manner, the travel upwards of the tappet can be regulated so as to detach or not to detach the selector jacks 12 which are retained by said retention ring 20 and thus maintain or modify the selection or non-selection position of the corresponding pusher jacks 4 upon their passage from the pressure cam 10.

The functioning is as follows: while the cylinder 1 of the needles is displaced in the direction of the arrow F, when each needle 2, together with relevant pusher jack 4 and relevant elastic selector 12, arrives in the region of the selection assembly, the pusher jack 4 is situated, according to the preceding selection, in a raised position or in a lowered position In the former case, the needle is in operating position and the selector jack 12 is retained by the retention ring 20. In the latter case, the needle is non-operating and the pusher jack 4 has its back in contact with the bottom of the groove 3 since it is constrained by the head of the selector jack 12 which is in the rest position, that is to say raised into the groove 13 the collar 14.

In the former case, the pusher jacks 4, which are raised, in contact with the lowering cam 9, are lowered into the selection position while those already lowered remain lowered. In the latter case, the selector jacks 12, which are raised, upon passage over the attraction magnet 25, are attracted downwards and retained by the retention ring 20, and at the same time the pusher jacks 4 which are not yet in contact with the bottom of their grooves 3 are thrust against this by the active profile of the pressure cam 10. Finally, before every new selection and after every preceding selection, all the pusher jacks 4 have their backs in contact with the bottom of the relevant grooves 3 and all the selector jacks 12 are bent downwards and retained by the retention ring 20.

At this point, the new selection is achieved in the following manner:

(a) for a needle in operation: by not supplying the coil 31 of the tappet 30 with current. In this manner, the corresponding selector jack 12 remains lowered since it is retained by the retention ring 20 underneath and the foot 6 of the pusher jack 4 is free to be arranged in the rest position, that is to say with its back raised from the bottom of the groove 3 of the cylinder 1 of the needles, and so its lower heel 8 is engaged by the raising cam 11 and the corresponding needle 2 is set in operation;

(b) for a needle not in operation: by supplying the coil 31 of the tappet 30 with current which is modulated in frequency and phase. In this manner, the tappet 30, vibrating vertically, strikes the corresponding selector jack 12 which, having detached itself from the retention ring 20, is raised into the relevant groove 13 of the collar 14, returning into the horizontal rest position, and its head 18 locks the relevant pusher jack 4 against the bottom of the groove 3 in such a manner that its lower heel 8 passes without being influenced by the raising cam 11 and the corresponding needle 2 remains out of operation.

In practice, the details of execution can vary in equivalent manner in form, dimensions, arrangement of the elements, and nature of the materials used, without moreover leaving the scope of the idea for solution adopted and therefore remaining within the limits of the protection afforded by the present patent of industrial invention.

I claim:

1. A needle selection device for circular knitting machines for women's stockings, comprising: a pusher jack associated with each of a plurality of needles of a needle cylinder, each pusher jack having two heels including an upper heel interacting, in a selection position, with a lower cam and a lower heel interacting, in a selection position, with a pressure cam, acting in a radial direction with respect to the cylinder, and with a raising cam; a horizontal collar formed of non-magnetic material, said horizontal collar being anchored around said needle cylinder, said horizontal collar defining a plurality of radial grooves; a plurality of horizontal elastic selector jacks, each selector jack being positioned in one of said radial grooves, each selector jack having a foot anchored on said collar and a head extending into a vertical groove receiving said pusher jack, and extending underneath a foot of said pusher jack in a rest position of said pusher jack; a permanently magnetized ring fastened below said collar, facing said selector jacks, said permanently magnetized ring being spaced a distance from said selector jacks to retain said selector jacks only when said selector jacks are inclined downwardly, removed from a horizontal rest position; a permanent magnet supported by a fixed structure with respect to said cylinder in a region of each pressure cam and immediately before said selection position for removing said selector jack from said horizontal rest position for urging said selector jack to said permanently magnetized ring, to said position inclined downwardly; a vertical tappet cooperating with vertical oscillation movement means for vertically oscillating said tappet, said vertical tappet being positioned between said permanent magnet and an inclined surface of said raising cam, and being positioned under said selector jack for selective detachment of said selector jack from contact with said permanently magnetized ring, whereby the position of said selector jack maintains or modifies a position of said corresponding pusher jack upon passage of said pusher jack over said pressure cam for determining non-operation or operation of a corresponding needle.

2. A device according to claim 1, wherein said permanent magnet includes pole pieces arranged on each side of said permanently magnetized ring, free ends of said magnet being positioned in a plane which is lower than a plane of pole pieces of said permanently magnetized ring.

3. A device according to claim 1, wherein said permanently magnetized ring is interposed between two rings of magnetizable material, ends of said two rings of magnetizable material being shaped to concentrate flux lines at a short distance from said permanently magnetized ring.

4. A device according to claim 1, wherein said vertical oscillation movement means comprises a coil held in position in an elastic manner, within a magnetic field generated by a movement means permanent magnet, said coil being supplied with modulated current for generating vibratory movement of a predetermined amplitude, frequency and phase.

* * * * *